United States Patent [19]

Tepoorten et al.

[11] 4,279,421

[45] Jul. 21, 1981

[54] ELECTRONIC GAMEBOARD

[75] Inventors: Darrell M. Tepoorten, 909 S. Bonnie Brae, Suite 207, Los Angeles, Calif. 90006; Steven A. Hechtman, Los Angeles, Calif.

[73] Assignee: Darrell M. Tepoorten, Los Angeles, Calif.

[21] Appl. No.: 50,075

[22] Filed: Jun. 19, 1979

[51] Int. Cl.[3] ..... A63F 3/02

[52] U.S. Cl. ..... 273/237

[58] Field of Search ..... 35/8 R, 8 A, 9 B, 10, 35/66; 273/1 E, 237, 313, 85 G; 340/323 R, 365 C, 365 VL, 366 E, 712, 718, 719

[56] References Cited

U.S. PATENT DOCUMENTS

| | | | |
|---|---|---|---|
| 3,086,143 | 4/1963 | Wolfe | 340/719 X |
| 3,187,321 | 6/1965 | Kameny | 35/10 X |
| 3,757,322 | 9/1973 | Barkan et al. | 35/9 B |
| 3,760,360 | 9/1973 | Reynolds | 340/365 VL |
| 3,888,491 | 6/1975 | Bernard et al. | 273/237 |
| 4,006,903 | 2/1977 | Barish | 273/237 |
| 4,019,745 | 4/1977 | Mustelier | 273/237 |
| 4,073,067 | 2/1978 | Beach | 273/237 |
| 4,078,257 | 3/1978 | Bagley | 340/365 VL |
| 4,082,285 | 4/1978 | Bathurst | 273/237 |
| 4,114,890 | 9/1978 | Yamamoto | 273/237 |

*Primary Examiner*—Vance Y. Hum

*Attorney, Agent, or Firm*—Poms, Smith, Lande & Rose

[57] ABSTRACT

An electronic game incorporates logic circuitry which generates and controls the movement of electronic representations of the gameboard playing pieces. A plurality of electronic displays are arranged to represent the playing surface of the gameboard, each display being capable of indicating electronic representations of all the playing pieces. The logic circuit initially causes the displays to indicate electronic representations of the in a position to begin the game. Associated with each display is a switch which initiates transfer of the electronic representations of the playing pieces between the various displays. The arrangement of the switches and displays allows the displays to be viewed through the switches. The circuit moves an electronic representation of any one of the playing pieces between any two of the displays upon the activation of the switches associated with the two displays. The logic circuitry may incorporate a programmable digital microcomputer and memory. The electronic displays may be implemented with segmental or liquid-crystal circuits. The gameboard is powered by a rechargeable battery. In one embodiment, a game of chess is implemented.

10 Claims, 12 Drawing Figures

FIG 1
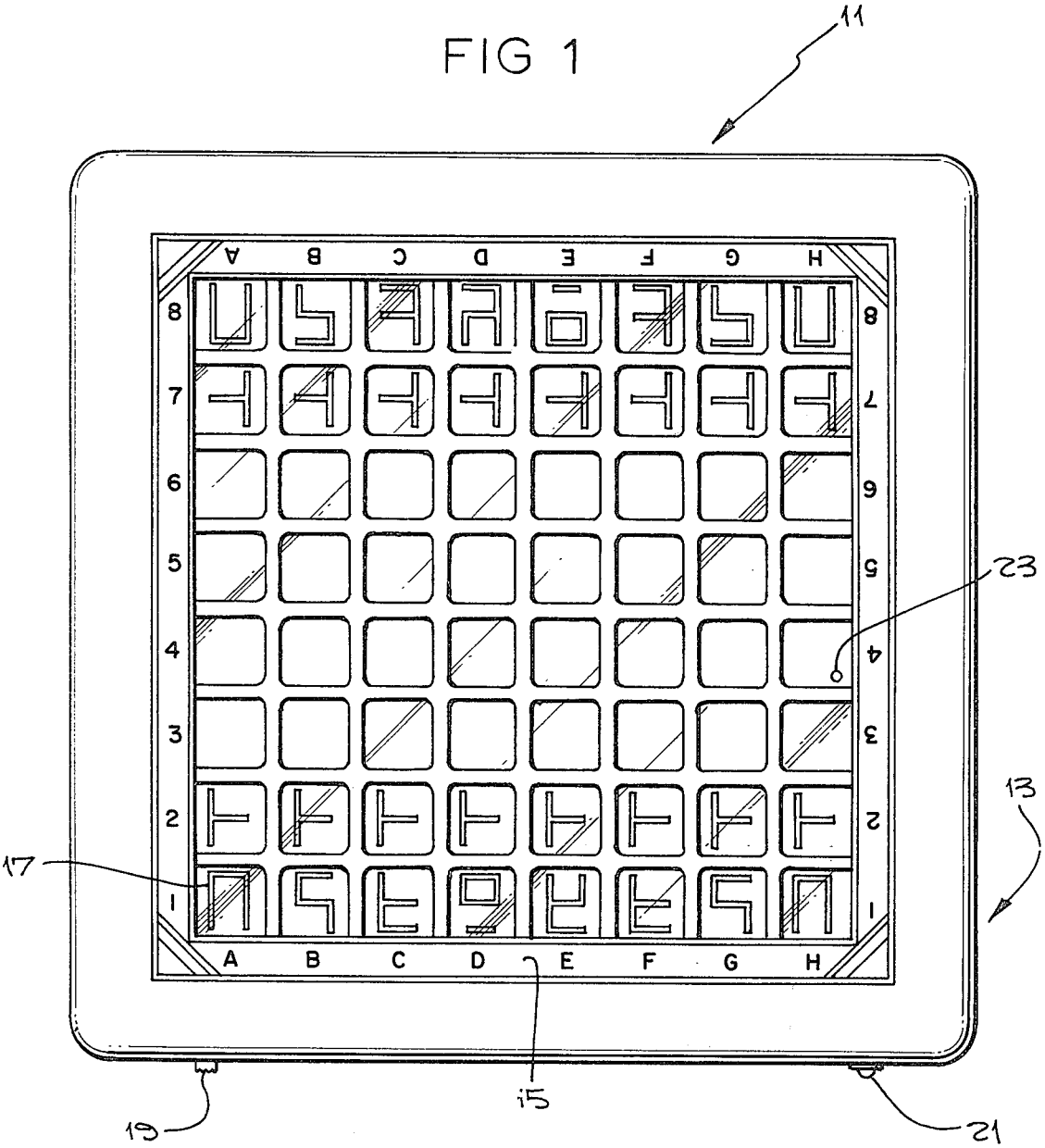
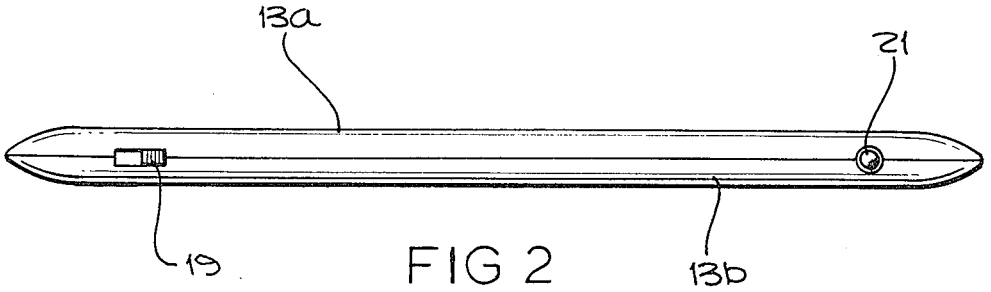
FIG 2

MAIN ROUTINE
(DISPLAY)

"MOVE" SUBROUTINE

"MODIFY" SUBROUTINE

ELECTRONIC GAMEBOARD

FIELD OF THE INVENTION

The present invention relates to gameboards, and in particular to gameboards utilizing electronic circuitry to generate and control the movement of electronic representations of the playing pieces.

BACKGROUND OF THE INVENTION

The playing of various games as a form of recreational activity is increasing in popularity. While certain games such as checkers have always been popular forms of recreation, certain other games such as backgammon are experiencing rapid growth. The rapid increase in popularity of these games has led to a variety of types and styles of gameboards and playing pieces. However, the vast majority of such game boards involve discrete playing pieces and gameboards. Accordingly, most games are designed to be played with the playing surface disposed horizontally. While certain types of gameboards, such as those having a magnetic subsurface, allow varying dispositions of the gameboards, the discrete nature of the playing pieces and the gameboard limits the mobility of such games and, in addition, results in playing pieces becoming lost.

Very few gameboards provide any integration of the playing pieces and the gameboard playing surface. Such an integration is especially attractive as it makes the game much more portable, thereby facilitating the playing of the game. Such portability has a direct effect on the popularity of the game.

The advent of small, but extremely powerful computer logic circuitry has allowed a great deal of flexibility to be incorporated in many of the newer games found in the marketplace. The use of such devices, generally referred to as microcomputers, allows a gameboard designer much flexibility in implementing a game. In particular, the use of such microcomputers allows a complete elimination of the playing pieces when the playing pieces are replaced by various electronic representations generated and controlled by the microcomputer.

In addition to the obvious increase in the portability of a game afforded by electronic generation and control of the playing pieces, such electronic control often allows simplified manual intervention by the game players. For example, a bank of switches can be used to control the movement of the playing pieces. This has the advantage of allowing those, such as the handicapped, an opportunity to participate in a game which might not otherwise be possible.

Accordingly, it is the principal object of this invention to enhance the enjoyment of playing various games as a form of recreation.

It is another object of this invention to increase the portability of games.

It is still another object of this invention to integrate the playing pieces and the gameboard surface.

It is another object of this invention to allow a gameboard to be utilized when disposed in a position other than the horizontal.

It is a final object of this invention to simplify the manual intervention required in the playing of games.

Other objects, features, and advantages of the present invention will become apparent from a consideration of the following detailed description and from the accompanying drawings.

SUMMARY OF THE INVENTION

The present invention, in a broad aspect, involves an electronic gameboard which generates and controls the movement of electronic representations of the gameboard playing pieces. The playing surface of the gameboard is formed by a plurality of displays, which show the representations of the playing pieces at each possible piece location on the playing surface. The displays initially show the representations of the playing pieces in a position to begin playing the game. Each display has a switch associated with it. Activation of switches associated with any two of the displays causes the representation of any one of the playing pieces to be moved between the displays.

In accordance with one aspect of the invention, logic circuitry connected to the displays and the switches is utilized to generate and to control the movement of the electronic representations of the playing pieces. The logic circuitry can include a programable digital microprocessor. A digital random access memory can be connected to the microprocessor to store the electronic representations of the playing pieces at each of the displays. A digital read-only memory can be connected to the microprocessor to permanently store a program which controls the operation of the microprocessor.

In accordance with the further aspect of the invention, the displays utilized to form the gameboard surface can be of the digital segmental type, or can be of the liquid crystal type.

In accordance with still another aspect of the invention, the switches utilized with the displays can be implemented with a crossbar switching matrix.

In accordance with another feature of the invention, the electronic gameboard can include a provision for indicating if any one of the electronic representations of the playing pieces is being moved between any two of the displays. The gameboard can also include a provision for regenerating, at each of the displays, the electronic representation of the playing piece currently at the display, and can also include provisions for cyclically generating the electronic representations of all of the playing pieces at any one of the displays upon successive activations of the switch associated with the display.

In accordance with still another aspect of the invention, the electronic gameboard can be used to implement various games such as chess or checkers. The implementation of the games merely involves defining electronic representations of the pieces in the desired game and then storing such representations in the circuit. These representations then form the entities which are operated upon by the circuit during the playing of the game.

In accordance with a another aspect of the invention, the switches utilized with the displays allow the displays to be viewed through them. The switches utilize several sheets of translucent material stacked upon the displays. In this arrangement, the first sheet of translucent material is disposed over the display, and includes upon its upper surface pairs of connected electrical conductors attached, each one of which passes along one side of the display. Above this pair of conductors is a second sheet of translucent material having holes at each corner of the display directly above each of the conductors. Above this second sheet is a third sheet of translucent material having, on the side closest to the first sheet, a second pair of electrical conductors disposed perpendicular to the conductors on the first sheet and located directly above the holes in the second sheet. This orientation of the conductors allows contact to be made between the pairs of electrical conductors by applying manual pressure to the third sheet, whereupon the upper and lower pair of conductors contact through the holes in the second sheet.

In accordance with a final feature of the invention, the switch arrangement described above can utilize a polarized sheet in conjunction with a transparent sheet to enhance the visual appearance of the electronic representations on the display means. Additionally, a checkerboard effect can be created for a group of such displays and switches by the use of an additional sheet of translucent material disposed above the other sheets. This sheet has portions above alternate displays removed, thereby creating a checkerboard effect on the playing surface.

Other objects, features, and advantages of the present invention will become apparent from a consideration of the following detailed description from the accompanying drawings.

BRIEF DESCRIPTION OF THE DRAWINGS

FIG. 1 shows a top view of an electronic gameboard incorporating the principles of the present invention and utilizing digital 7-segment representations of the playing pieces used in a game of chess;

FIG. 2 is a side view of the electronic chessboard shown in FIG. 1;

DETAILED DESCRIPTION

Referring more particularly to the drawings, FIG. 1 shows a top view of an electronic gameboard, generally denoted 11, implementing the principles of the present invention. All of components of the electronic gameboard are mounted in a housing 13, which may be constructed of metal, plastic, or any other easily-formable material. The playing surface of the gameboard 11 is formed by a plurality of digital display circuits or "chips" 17. The digital display circuits 17 may be of the segmental type, the liquid-crystal type, or the like.

Figure 3:
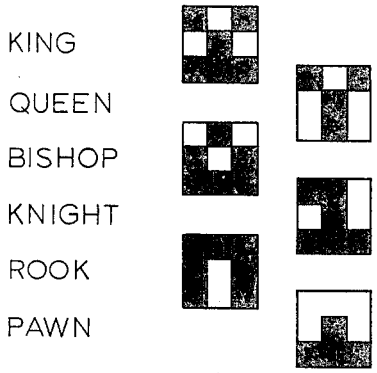
FIG. 3 depicts an alternate representation of the chess pieces which would be possible if liquid-crystal displays are used instead of 7-segment displays shown in FIG. 1.

As shown in FIG. 1, the electronic gameboard 11 is configured as an electronic chessboard. In the chessboard, the display chips 17 forming the playing surface of the chessboard 11 are of the seven-segment type. Accordingly, a unique set of chess characters, based on a seven-segment representation, have been devised and are shown in FIG. 1 in their initial positions to begin a game of chess. If liquid-crystal type display chips are utilized instead of the segmental type, a different representation of the playing pieces would be possible. One such presentation, based on a nine-block, liquid-crystal display is shown in FIG. 3.

Figure 4:
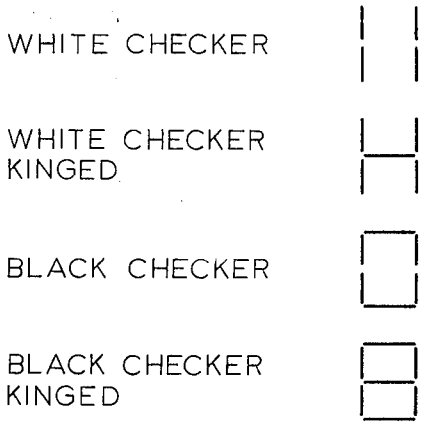
FIG. 4 shows 7-segment electronic representations of the playing pieces used in a game of checkers if the present invention is utilized to implement an electronic game of checkers.

Although the principles of the present invention are utilized to implement an electronic chessgame, other games could be similarly implemented. For example, FIG. 4 shows the seven-segment electronic representations of the playing pieces in a game of checkers. The determination of the particular segments to be used to create electronic representations of various gameboard playing pieces is controlled by the logic circuit in the gameboard and may be easily changed.

Regarding the physical construction of the gameboard housing 13, FIG. 2 shows that the housing includes an upper half 13*a*, and a lower half 13*b*. At one edge of the housing is an on-off switch 19 and a reset switch 21. The on-off switch 19 applies power to the internal circuits, which causes the initialization of the sequence of operations performed by the circuit. As will be discussed, the gameboard is designed to "remember" the configuration of playing pieces on it when turned off. Accordingly, when the on-off switch 19 is pushed to the "on" position, the internal circuitry is configured to begin where the last game left off.

The gameboard may be also reset by the reset switch 21. The reset switch 21 also initializes the sequence of operations performed by the internal circuitry and, in addition, causes the displays 17 to place the electronic representation of the playing pieces in a position to initially begin a game of chess.

Also, as the power for the internal circuitry is provided by battery, a recharging jack may be provided on the edge of the housing 13 to allow a re-energizing of the battery. If the battery charger utilized has sufficient current capacity, the recharging may occur when the game is in progress.

As will be observed from FIG. 1, the upper half of the housing 13*a* has a band of letters and numbers 15 around the displays 17 corresponding to the established designations for the various playing locations on the chessboard. It will also be observed that at the display chip corresponding to location 4H, is an indicator 50. As will be explained in more detail hereinafter, this indicator 50 is activated whenever one of the electronic representations of a playing piece is in the process of being moved from one display 17 to another, or when a series of the representations of the playing pieces are being generated at one of the displays 17.

Figure 7:
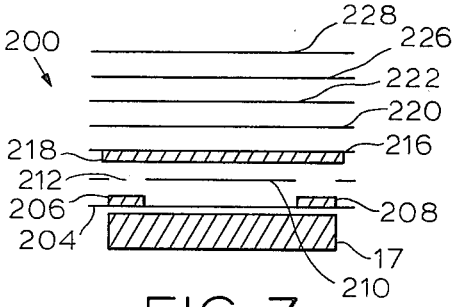
FIG. 7 is a cross-sectional view of the display and associated switch at each of the playing locations on an electronic gameboard shown in FIG. 1.
Figure 8:
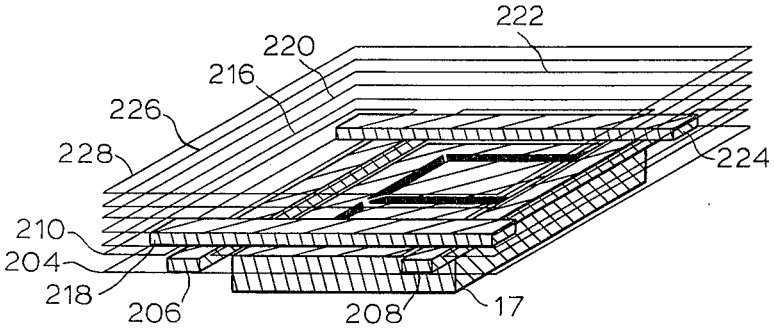
FIG. 8 is an isometric view of the display and switch shown in FIG. 7.

The initiation of the movement of the representations of the playing pieces is controlled by a plurality of translucent switches 200, located between the top of the displays 19 and the upper half of the housing 13*a*. Because of their translucent nature, the switches not separately shown in FIG. 1. Each of these switches 200 is formed by a series of translucent panels and wires between the display chips 17 and the playing surface of the gameboard 11. The orientation of the switches 200 in relation to the displays is shown in FIGS. 7 and 8 will be described in detail hereinafter.

Figure 5:
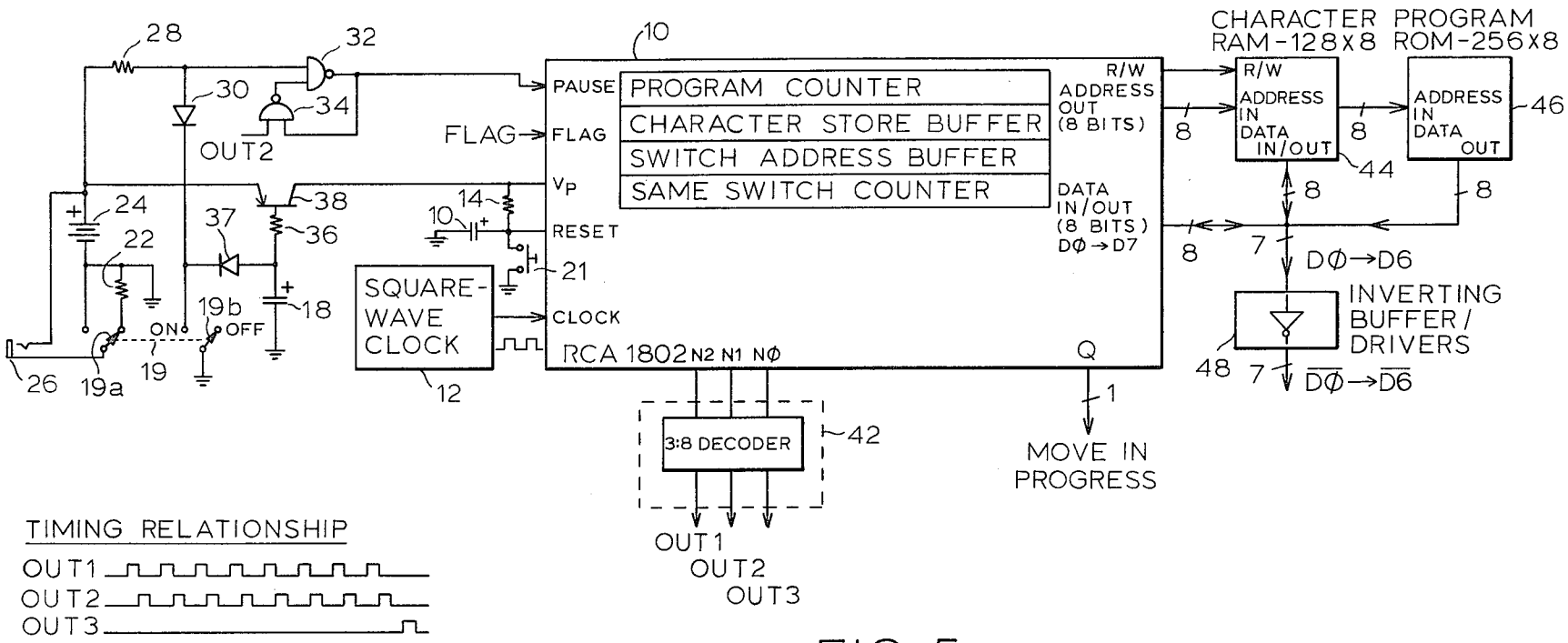
FIG. 5 is a schematic diagram of a portion of a logic circuit, illustrating the principles of the present invention, for an electronic gameboard.
Figure 6:
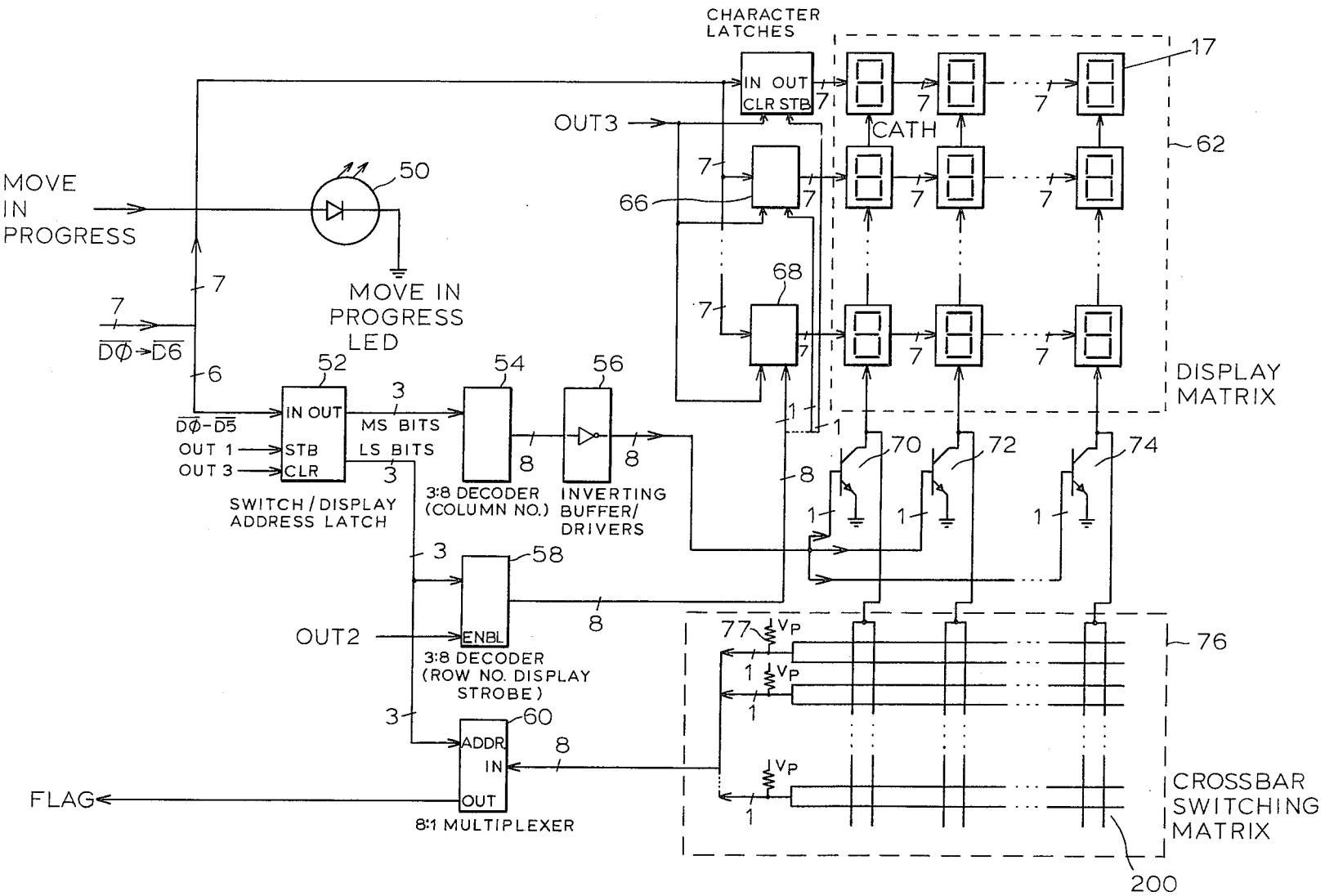
FIG. 6 is a schematic diagram of the remainder of a logic circuit, illustrating the principles of the present invention, for an electronic gameboard.

FIGS. 5 and 6, show an electronic logic circuit which is implementing the principles of the present invention. Referring particularly to FIG. 5, the logic circuit is built around a programmable digital microprocessor 10. The digital microprocessor 10 shown in FIG. 5 is an RCA type 1802. This device is a large-scale integration COS/MOS (complementary metal-oxide field-effect transistor) device. The 1802 is an eight-bit register-oriented, central-processing unit designed for use as a general-purpose computing or control element for a wide range of stored-program systems. The 1802 has an eight-bit parallel organization with a bidirectional data bus and a unidirectional address bus. Within the 1802 are sixteen 16-bit registers which can be used as program counters, data pointers, or data registers. As shown in FIG. 5, the present invention uses four of such registers to perform the functions of: (1) a program counter; (2) a buffer to store one of the electronic representations of one of the playing pieces; (3) a buffer to store the address of one of the switches; and (4) a counter to detect the number of times one of the switches has been pressed.

The commands accepted by the 1802 are a Pause command, which causes the processor to stop operation; a Flag command which causes the processor to cease operating on the program it is processing and jump to another program or subroutine; and a Reset command which causes the processor to begin a predefined initialization sequence. The output timing from the 1802 is achieved by three input-output or I/O commands (N2, N1, and N0). Also provided is a programmable output port (Q) which may be utilized for implementing special functions.

As shown in FIG. 5, the microprocessor 10 is powered by a battery 24, which connects to the Vp voltage input through a PNP transistor 38. A time constant network defined by resistor 14 and capacitor 16 functions as a power-on reset circuit, applying a reset pulse to the Reset input of the microprocessor 10 when power is first applied. Pressing the reset switch 21 causes the microprocessor 10 to rewrite the playing piece representations in a position to begin a game of chess.

The circuit shown in FIG. 5 incorporates a special power-down circuit which permits the status of the playing board to be "remembered" by the microprocessor when power is removed from the board through the use of the on-off switch 19. When the switch 19 is in the "off" position shown in FIG. 5, a capacitor 18 connected through a resistor 36 to the base of a transistor 38 is allowed to charge through the emitter-base reaction of the transistor 38. Accordingly, the transistor 38 enters the cutoff state and no battery voltage flows into the $V_p$ terminal of the microprocessor 10. In the configuration, a resistor 28 pulls the upper input of a NAND gate 32 connected to the Pause input of the microprocessor 10 to a logical HIGH, thereby disabling the gate 32.

As soon as switch 19 is moved to the "on" position, one portion of the switch 19*b* causes a diode 37 connected to it to rapidly to discharge the capacitor 18. The action of the capacitor 18 in discharging allows the transistor 38 to saturate and thus provide power to the microprocessor. As this occurs, the upper input of logic NAND gate 32, is pulled to a logical LOW condition through a diode 30. Accordingly, the output of the gate 32 is HIGH, thereby enabling the other NAND gate 34. The latter gate 34 then waits for an OUT2 pulse, which is generated from the I/O output of the microprocessor 10 through a 3:8 decoder 42 attached thereto. (The output of the decoder 42 is controlled by the N2, N1, and N0 outputs of the microprocessor 10, which create three timing signals OUT1, OUT2 and OUT3, as shown in FIG. 5.) The OUT2 pulse is utilized by NAND gate 34 to generate a Pause command to the microprocessor, thereby causing cessation of its operation at a safe operating point. When the OUT2 pulse arrives, the output of the lower gate 34 goes LOW, causing the output of the upper gate 32 to go HIGH, thereby generating a Pause signal.

Thus, when the switch 19 is moved to the "off" position, power is removed in a controlled fashion from the microprocessor 10. However, the circuit is wired such that the battery is always connected to the microprocessor memory. As the configuration of the playing surface is preserved in the memory, this provision allows the circuit to "remember" the configuration of the playing surface when the game is off. As the microprocessor memory is a device which consumes little power, only a negligible amount of current is drawn from the battery 24 by the memory. In the power circuit shown and discussed above, a jack 26 is shown which may be utilized with an external battery recharger to recharge the internal battery 24.

As shown in FIG. 5, a square wave clock generator, 12 connected to the clock input of the microprocessor 10, is the source of the clock pulses which step the microprocessor 10 through its logical sequence of operations. Such a single-phase clock may be implemented by a distinct crystal, or, as well known in the art, by the circular connection of a series of logical inverters. It has been found that a clock frequency in the range of 2 megacycles is appropriate for the operation of the computer.

The sequence of operations of the computer is controlled by a software program permanently stored in a digital Read Only Memory (ROM) circuit or "chip" 46. Accordingly, the microprocessor is referred to as being under firmware control. As shown in FIG. 5, a ROM chip 46 with an organization of 256 words by eight bits/word is sufficient to store the program to be hereinafter described. In a prototype electronic gameboard, a type 74S471 ROM was used, which is a Schottky-type ROM. It is to be understood, however, that this logic circuit, as is the case with all the logic circuits hereindescribed, may be implemented with MOS, TTL (transistor-transistor logic), or other well-known logic families. The output of the ROM chip 46 is connected to the 8-bit, bidirectional data bus of the microprocessor 10. The address input of the ROM chip 46 connects to the unidirectional address bus of the microprocessor 10.

The configuration of the chessboard playing surface, i.e., of the electronic representations of the chess game playing pieces at each of the display chips, is stored in a digital Random Access Memory (RAM) circuit or "chip" 44 connected to the microprocessor 10. The RAM memory 44 is organized as 128 words by eight bits/word. As each of the electronic representations of the chess game playing pieces requires seven bits, and as there are 64 gameboard playing locations, this organization utilizes only one-half of the available memory space and thus allow the complete configuration of the chess board playing surface to be stored within the RAM chip 44.

As the playing pieces are variously moved from one square to another, the microprocessor 10 updates the configuration of the chessboard within the RAM chip 44. The RAM chip utilized may be of the type CPD1823S or the like. This particular type of RAM will store its data at very low levels of power. Accordingly, when the game is off, the RAM chip draws only a negligible amount of power from the battery 24 and thus functions as a non-volatile memory. It is this feature which, when used in conjunction with the power-down circuitry previously described, which allows the microprocessor 10 to "remember" the configuration of the gameboard playing surface when the on/off switch 19 is moved to the off position.

Communication between the RAM chip 44 and the microprocessor 10 is via the address and data buses of the microprocessor 10. The address bus of the microprocessor 10 connects to the address input of the RAM chip 44 and selects a particular location for reading or writing. As the address bus of the microprocessor 10 also connects to the RAM chip 44, an appropriate decoding means (which is not separately shown) is used with the address bus to route the proper address to the proper device. The particular data to be written into or read from the RAM 44 passes via the bidirectional data bus to the microprocessor 10 and to the remainder of the electronic circuit. The determination of whether data is to be written into or out of the RAM 44 is determined by a Read/Write control line connected to the RAM 44.

Communication of the microprocessor 10 and RAM chip 44 with the remainder of the logic circuitry is made by means of an inverting buffer/driver circuit 48. As shown in FIG. 5, seven bits of the eight-bit data bus flow from the microprocessor into the buffer 48. This is possible since only seven bits are necessary for the generation of all of the electronic representations of the chessgame playing pieces. The buffer circuit 48 is utilized in the circuit to supply sufficient current to the remainder of the logic circuitry, as the output current capability of the microprocessor 10 is insufficient for this purpose. As before, such buffer/drivers can be implemented with whichever family of logic devices is chosen for the circuitry. In the particular prototype implementing the principles of the present invention, inverting buffer type CD4049 was utilized.

The function of the microprocessor 10 is to supply and to control the movement of the electronic representations of a set of chessgame playing pieces or characters to a matrix 62 of display chips 17, and to receive switching information from a crossbar switching matrix 76. The hardware shown in FIGS. 5 and 6 accomplishes this, in accordance with the firmware in the ROM chip 46, as follows. Through the buffer circuit 48 passes a series of addresses and the characters at those addresses. One address is allocated for each of the 64 display chips 17 which form the playing surface of the electronic chess game. The addresses pass into a switch-display address latch circuit 52 and the characters pass into to a series of eight character latches, shown in abbreviated fashion as 64, 66, and 68.

The determination of whether, at any given time, the information passing through the first buffer 48 is an address of one of the display chips 17, or is a character to be displayed at the display chip 17 determined by the three timing signals OUT1, OUT2, and OUT3. The relationship between these signals is that, prior to every OUT3 pulse, there is a sequential set of eight alternating OUT1 and OUT2 pulses. The presence of an OUT2 pulse defines the information present at the buffer 48 to be a character, while the presence of pulse OUT1 defines the information to be a display chip 17 address. Accordingly, as the microprocessor alternately outputs address and character information, in a serial fashion, the addresses end up latched into the address latch 52 via OUT1 and the characters end up latched into the character latches via OUT2. As will be explained the microprocessor 10 updates the displays in a row-by-row sequence.

As indicated, only six of the seven bits output by the buffer 48 reach the address latch 52, as only that many are necessary to address the 64 locations. As the address latch 52 stores the address data until another OUT1 pulse presents another address to it, the address remains constant while the character corresponding to the playing piece at that address is written into the character latches. Note that both the address latch 52 and the character latches 64, 66 and 68 are standard eight-bit address latches, which receive the data into them when the STROBE (STB) input is pulsed. The data remains in the latch until another STB pulse arrives, or until the CLEAR (CLR) input is pulsed. In the prototype unit built, type 74LS273 latches were utilized.

The organization of the display matrix 62 is on a row and column basis, as the surface of a chess board has eight rows and eight columns. Accordingly, the six-bit address present in address latch 52 has its upper three, or the most significant, bits the column address. The lower three, or the least significant, bits are the row address. Therefore, one six-bit address defines a row and a column, the intersection of which defines the particular display corresponding to the address.

The upper three bits of the address are routed from the address latch 52 into a 3:8 decoder. The decoder takes the three-bit coded binary definition of the particular column to be energized and decodes it into eight separate lines, each passing, by means of another inverting buffer/driver 56, to eight NPN transistors, denoted in abbreviated form as 70, 72, and 74. Each transistor drives the cathode input of a column of common-cathode, seven-segment, lighting emitting diode (LED) displays or the like. When a particular one of the transistors is selected, it activates a column of displays by grounding the cathode terminal of the displays in the column. Note that a common-anode type of display could be utilized by changing the buffer 56 to be of the non-inverting type, by inverting the character bit patterns, and by utilizing PNP transistors configured with their emitter terminals connected to the battery 24 instead of the ground.

The lower three bits of the address are routed from the address latch 52 into a similar 3:8 decoder 58. As is the case with the other decoder 54, this decoder may be of type 74LS138 or the like. The decoder 58 for the least significant bits transforms the three-bit binary representation of a particular row into eight discrete lines, each of which connect to one of the eight data latches 64, 66 and 68 which accept the chessboard characters from the microprocessor. These lines are routed to the STB inputs of the latches. When the OUT2 pulse is generated by the microprocessor, it enables the output of the decoder 58, effectively creating a pulse which strobes the data from the first buffer 48 into a unique one of the data latches 64, 66 and 68.

Accordingly, after an address and a corresponding character has been output by the microprocessor, a particular column of the displays is energized by one of the transistors, and a particular row of the displays has a character of one of the chessgame playing pieces presented to it. This results in the particular display present at the intersection of the particular row and column selected to have written into it the character representing the chesspiece at that position.

The OUT3 line indicated on FIG. 6 is used, as will be discussed, by the microprocessor to clear the displays as the playing surface is continually updated to reflect the position of the playing pieces.

As described, associated with each of the display chips 17 is a switch 200 which forms part of a crossbar switching matrix 76. As shown in FIG. 5, the crossbar switching matrix 76, like the display matrix 62, is organized as eight rows by eight columns. The physical construction of one switch 200 of the switching matrix 76 is shown in FIGS. 7 and 8. The electrical operation of the switching matrix can be understood from FIG. 6. The writing of an character for one of the chess pieces from the microprocessor 10 into the display matrix 76 involves selection of a row and a column. The upper three bits of the address are used to select one of the eight columns by way of the driver transistors 70, 72 and 74. These transistors also are connected to the columns of the crossbar switching matrix 76.

Accordingly, as each column of displays is energized by grounding the cathode connection of the displays, the column of switches over that column of displays is also activated. The lower three bits of the address, which define the row of the particular display to be addressed, are utilized by an 8:1 multiplexer 60 to examine one of the rows of the crossbar switching matrix. If one of the playing elements is to be moved, the switch corresponding to that display element is pressed. The effect of pressing the switch is to connect the grounded column in the crossbar switching matrix with one of the rows. As all of the rows in the switching matrix are pulled up to the level of the supply voltage by pullup resistors 77, the effect of the connection is to ground one switch in the crossbar switching matrix 76, the switch being at the intersection of the grounded column and the selected row.

As the rate of updating the displays is much quicker than one can touch and remove one's finger from one of the switches, as the particular row of displays is updated, the multiplexer 60 will have its input switched, by means of the lower three address bits, to examine the corresponding row in the crossbar switching matrix as the rows are updated. Accordingly, the ground on the particular row, created by the contacted row and column, will be transmitted through the multiplexer and be routed to the FLAG input of the microprocessor. As will be discussed in the firmware description, this initiates a subroutine which causes begins a process by which in the a character at one of the displays may be moved to another of the displays.

The physical construction of the switches 200 corresponding to each display 17 is shown in FIGS. 7 and 8. A sheet of translucent plastic material 204 overlays the complete group of display chips 17. Onto this sheet are bonded, for each column of displays 17, a pair of vertically disposed, with respect to the display 17, electrical conductors 206 and 208. As shown in FIG. 6, each pair of wires is connected to the particular driver transistors 70, 72 and 74 corresponding to one column on the playing surface.

Above the bottom sheet of translucent material 204 is disposed another sheet of translucent material 210. This sheet of translucent material 210 has a cutout 212 at each corner of each of the displays 17. Disposed above this sheet 210 is another sheet of translucent material 216. Bonded to the underside of this sheet 216, and oriented in a direction perpendicular to that of other electrical conductors 206 and 208 are another pair of electrical conductors 218 and 224. These electrical conductors 218 and 224 are positioned above the cutouts 212 along each edge of each display.

Each pair of conductors 218 and 224 is routed to one input of the 8:1 multiplexer 60. Above the sheet 216 supporting the rows of pairs of electrical conductors can be four additional sheets of translucent material 220, 222, 226 and 228. The first of these sheets 220 is of a contrasting color such as red with respect to the sheets below it, which are generally clear. This sheet 220 helps to shield the details of the switch assembly from the players. The next two sheets 222 and 226 are grey in color and clear, respectively, with the grey sheet 222 being polarized. These sheets 222 and 226 also shield the switch assembly from view and do so in a manner giving a mirrored effect to the switches. The top sheet 228 has an area equal to the size of the display removed over alternate displays, thus creating a checkerboard effect for the playing surface of the gameboard.

Activation of the switch at each display is done by pressing on the sheets of plastic, thus causing the upper conductors 218 and 224 to contact the lower conductors 206 and 208 through the cutouts 212 in the second sheet 210. This arrangement ensures that complete electrical contact will be made when any point above the displays, except dead center, is pressed. This unique switch configuration thus allows the display to be viewed through the sheets of translucent material and still provide the necessary electrical contact when pressed.

Regarding the firmware program stored in the ROM chip 46, reference will be made to FIGS. 9 through 12 which show the logical sequence of operations performed by the microprocessor 10 in controlling the operation of the electronic gameboard. It is to be understood that the flowchart is written in a form which allows implementation with a variety of logical circuits, and consequently the invention is not restricted to the particular microprocessor used to implement a prototype version of the invention.

Figure 9:
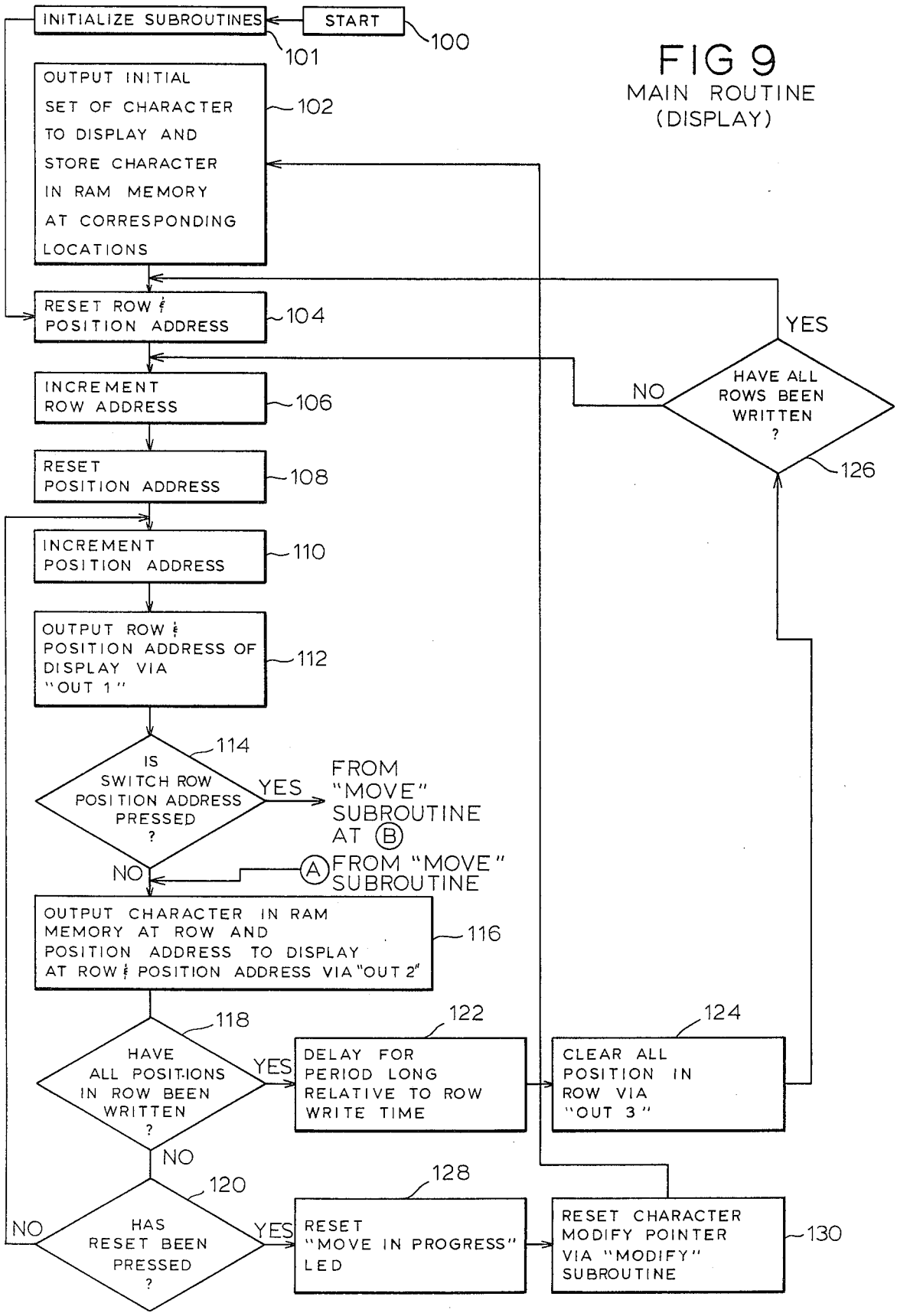
FIG. 9 is a flow diagram showing the sequence of operations performed by a logic circuit in continually updating the digital displays which form the playing surface of the electronic gameboard.

The main program from which the operation of the gameboard is controlled is shown in FIG. 9. In this program, the application of power to the microprocessor 10 by the on-off switch 19 causes the program to jump to its beginning step 100. The next steps 101 and 104 are to initialize the subroutines shown in FIGS. 10 and 11 and to reset a register within the microprocessor which is utilized to generate the row and position (or column) addresses of the displays and switches. After these steps are done, the row address is incremented 106 to that of the first row on the playing surface. The next step 108 is to reset the position address, if it has not already been done previously (as will occur during the update of the various rows). After the position address has been reset, the position address is incremented (110). At this time, the address representing the first display in the first row has been generated. After this, a combined row and position or column address is output to the circuit via the OUT1 timing pulse. At this time, the particular switch at that position is examined, and if it has been pressed, the "Move" subroutine, shown in FIG. 10 and discussed below, is performed. Assuming the switch has not been pressed, the character stored in the RAM memory at the particular row and position address selected is sent to the particular display defined by the current row and position address via the OUT2 timing pulse (112). The program then decides (118) whether all of the displays in a particular row have had a character sent to them. If not, and if the reset switch has not been pressed (120), the position address is incremented (110) and the next display in a particular row is updated.

If the reset switch has been pressed, the program outputs (102) a set of characters to the displays corresponding to initial placement of the playing pieces on the chessboard. Simultaneously, the program stores these characters in the RAM chip 44 at the assigned locations corresponding to the display chips 17 in the display matrix 62. The program then moves to the next step 104 which is the same step that is performed after the subroutine initialization that occurs when the game is first turned on.

Once all of the positions in a row have been updated, the program stops operation (122) for a time period which is long relative to the time it took to write all of the displays in the row. Then, all of the displays in a particular row are cleared by the OUT3 timing pulse (124). A decision (126) is then made as to whether all the rows have been written. If not, the row address is incremented (106) and the displays in that row are then written into and then cleared. This process continues for each of the rows of displays in the display matrix. When all the rows have been written, the microprocessor begins writing the first row again (104).

As can be seen, the process of continually updating the playing surface of the chessgame involves writing characters into the row of displays, clearing the displays, writing another row of displays, etc. As a result, all of the displays are continually updated and each switch at each display is simultaneously examined. The delay after writing each row before clearing it is necessary to produce an even brightness for each of the displays in a row. (That is, the duty cycles for the first and last positions in a row relative to the write-to-clear time each other are different because the first position was written some time prior to the last position. The long delay thus normalizes the duty cycles for all of the positions in each row.) Also, as shown in FIG. 9, if the reset switch has been pressed (120) the "Move in Progress" LED and the "Character Modify" pointer (which are explained hereinafter) are reset (128 and 130) and the initial position of the playing pieces is reestablished.

Figure 10:
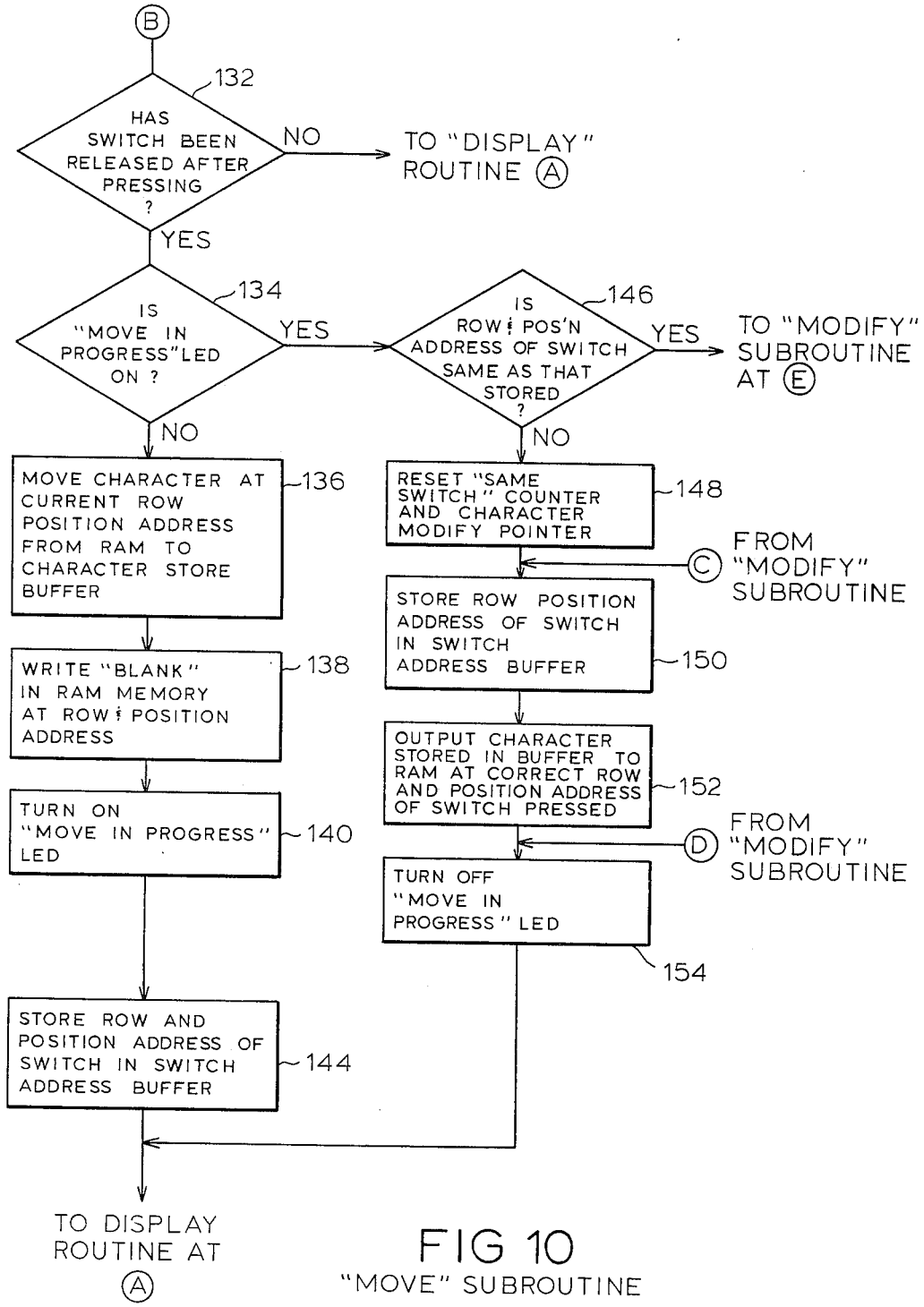
FIG. 10 is a flow diagram showing the sequence of operations performed by a logic circuit in transferring an electronic representation of one of the gameboard playing pieces between any two of the displays upon activation of the switches associated therewith.

FIG. 10 shows the sequence of operations performed by the program in moving a character between any two displays upon the activation of the switches associated with the displays. The routine shown in FIG. 10 is referred to as the "Move" subroutine as it is entered from the main routine shown in FIG. 9. As seen in FIG. 10, the initial entry into this subroutine occurs (132) when the circuit detects the pressing of the switch associated a particular display as that display is about to be updated (114). If the switch has been pressed, the program departs from the main routine shown as FIG. 9 and jumps to the subroutine shown in FIG. 10.

The initial decision 132 upon entering the subroutine is to decide whether the switch has been released after it has been pressed. If the switch has not been released, the main routine shown in FIG. 9 is reentered (116) and the character at the particular display associated with the switch is updated. This step 132 is necessary as a switch closure is defined in the logic circuitry as a sequential contacting and uncontacting of the conductors in the crossbar switching matrix 76. The program is designed to essentially "debounce" the switch. That is, the release of the switch causes a "one-shot" effect whereby the program will not recognize another switch closure for a certain amount of time.

If the switch has been validly activated, as described above, the next step 134 in the subroutine is to decide whether the "Move in Progress" LED 23 is on. The "Move in Progress" LED 23 is, as has been described, one of the decimal point indicators on the display chip at location 4H. This LED 23 is driven directly by the "Q" output of the microprocessor and its illumination signifies that a character is in the process of moving between two of the display chips 17.

The subroutine shown in FIG. 10 is entered each time a switch is pressed. Accordingly, the first time a switch is pressed, the "Move in Progress" LED 23 will not be on and the program will take a logical branch (134) downward in FIG. 10 to the next step 136. This next step 136 is to move the character at the particular row and position address of the switch, which is also the row and position address of the display associated with the switch, from the RAM chip 44 to the "Character Store" buffer in the microprocessor 10. After this, the next step 138 is to write a "blank" into the RAM chip 44 at the row and position address of the switch. Thus, on the next update of the display, a "blank" will be sent to the display, which will have the effect of erasing the character previously displayed. At this point, the next step 140 is to turn on the "Move in Progress" LED 23.

The final step 144 occuring upon the first pressing of one of the switches is to store the row and position address of the switch in the "Switch Address" buffer in the microprocessor 10. Accordingly, after any one switch has been pressed, the microprocessor has in its internal registers the character previously present at the display associated with the switch and the row and position address of the switch. At this point (144), the subroutine shown in FIG. 10 reenters (116) the primary routine shown in FIG. 9, and the updating of the rows of displays continues.

The updating of the rows of displays continues until another switch in the crossbar switching metrix is pressed. At this point (144), an exit is again made to the subroutine shown in FIG. 10. The initial step 132 upon entry is to again decide whether the switch has been released. Assuming it has, the next step 134 examines the "Move in Progress" LED 23. The "Move in Progress" LED 23 is "on" the second time the subroutine is entered because of the previous activation of one of the switches. Accordingly, the decision step 134 regarding the LED follows a different branch to the next step 146. In this step 146, the row and position address of the switch which has just been pressed is examined and compared against that stored in the "Switch Address" buffer when the last switch was pressed.

If the switch address is the same, the subroutine (FIG. 11) which is used to modify the electronic representation at one of the displays is entered at 156. Assuming the row and position address of the switch is different from that stored, the decision step 146 exits downwardly in FIG. 10 and passes to a step 148 which resets the "Character Modify" pointer utilized in the subroutine shown in FIG. 11. Also reset is the "Same Switch" counter used by the subroutine of FIG. 11.

After reseting the "Character Modify" pointer, the row and position address of the switch just pressed is stored (150) in the "Switch Address" buffer. Following this, the character previously stored in the "Character Store" buffer is sent to the RAM chip 44 at the row and position address just stored, which is the row and position address of the switch just pressed (152). Accordingly, the character appears, at the next update, at the location of the switch last pressed. The last step 154 performed, prior to returning to the primary routine shown in FIG. 9, is to turn off the "Move in Progress" LED 23. This signifies the end of a move of a character and a return to the continuous updating of the rows.

It is thus seen that the process of moving one of the characters between two of the displays involves the sequential activation the switches associated with the displays. Upon activation of the first switch, the character at its associated display, along with the address of the switch, is moved into the microprocessor 10 and a blank character sent to the display. Upon activation of the next switch, the character in the microprocessor is moved out to the display chip associated with that switch. As mentioned, the "Move in Progress" LED 23 is used to indicate that such a process is occuring.

Figure 11:
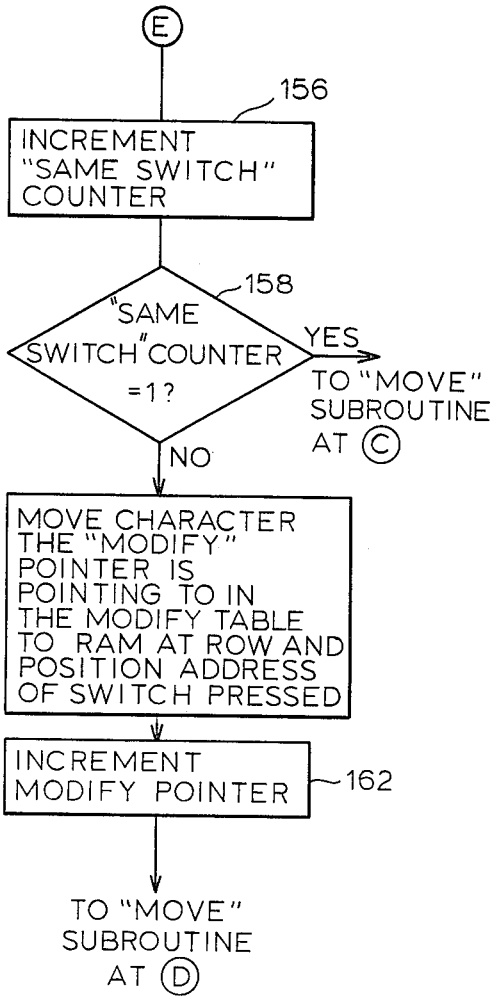
FIG. 11 is a flow diagram showing the sequence of operations performed by a logic circuit in modifying the electronic representation of a playing piece at any one display.
Figure 12:
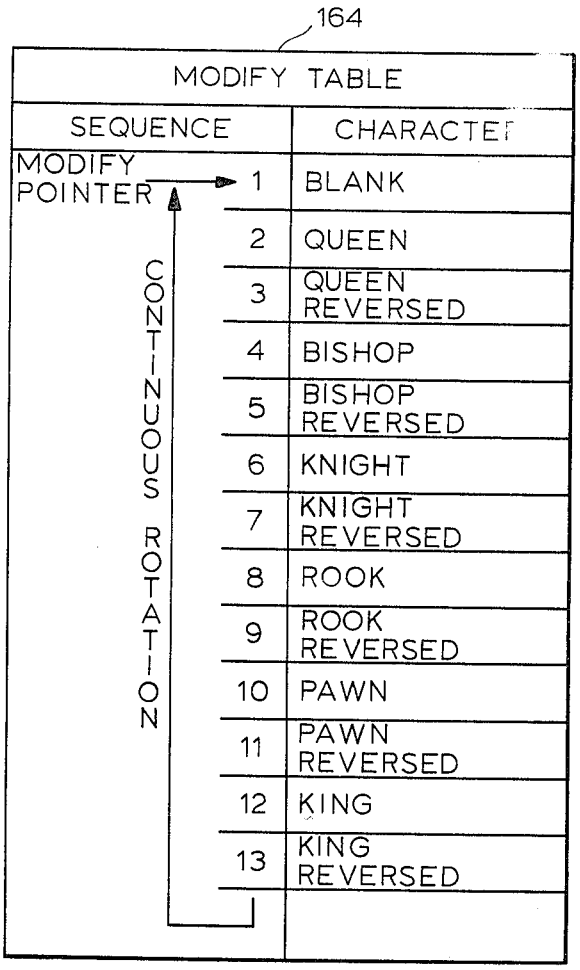
FIG. 12 is a table showing the sequence of characters generated at any one of the displays by the flow diagram shown in FIG. 11.

FIG. 11 shows the subroutine utilized by the microprocessor to sequentially generate all of the characters at any one display chip. This subroutine, referred to as the "Modify" subroutine is primarily utilized when the same switch is sequentially pressed more than twice. Such a sequential pressing of one of the switches would be performed when, for example, a wrong or illegal move has been made resulting in a character being lost and it is desired to reestablish that character at its position prior to the move. Upon the sequential activation of one the switches, the subroutine causes the sequence of characters shown in FIG. 12 to be generated at the display associated with the switch. The reversed characters shown in FIG. 12, are necessary in order to distinguish one player's characters from another's. That is, the "reversed characters" are actually the set of characters for one of the players.

The initial entry into the "Modify" subroutine occurs from one of the steps 146 in the subroutine shown in FIG. 10. That step 146 occurs when a second switch closure from any switch on the board is detected. In this step 146, the row and position address of the switch is compared against the row and position address of the previous switch, stored within the "Switch address" buffer in microprocessor 10. If the addresses are the same, the program departs from the "Move" subroutine to the "Modify" subroutine.

The first step 156 in the "Modify" subroutine is to increment the "Same Switch" counter. This counter, as will be recalled, was cleared in one of the steps 148 in the "Move" subroutine. After the "Same Switch" counter has been incremented, a check 158 is made to determine if the magnitude of the count of the counter is equal to one. If it is, which signifies that it is a second pressing of that switch, the program returns (150) to the "Move" subroutine, which then stores the row and position address of the switch. The next step 152 in the "Move" subroutine is to output the character currently stored in the "Character Store" Buffer to the row and position address of the switch. The final step 154 is to turn off the "Move in Progress" LED and return to the main progress in FIG. 9, which continues updating the displays.

Accordingly, if the same switch is pressed only twice in a row the sequence of operation described above causes the character first at the display to be redisplayed. That is, upon the first pressing of the switch, the character at that display is stored and a blank is substituted in its place. Upon the second pressing of the switch, the character store is reoutput to the display. As the character stored was the character originally at the display, this process results in the original character reappearing.

When the same switch is pressed a third time, which again causes the program to enter the "Modify" subroutine, the first step 156 is to again increment the "Same Switch" counter. As the same switch counter will now have a count of two, which represents the third pressing of the switch, the next step 158, which tests to see if the counter has a value of one, fails and consequently the program stays within the "Modify" subroutine (160) instead of returning to the "Move" subroutine. The next step 160 in the "Modify" subroutine is to move the character at which the "Modify" pointer is pointing at in the modify table (FIG. 12) to the RAM chip 44 at the row and position address of the switch pressed. The "Character Modify" pointer is a variable in the program which addresses the locations in the ROM chip 46 which permanently store electronic representations of the various playing pieces. As shown in FIg. 12, the initial character which the "Modify" pointer addresses is a blank. Accordingly, this blank character is moved to the display associated with the switch pressed. The next step 162 is to increment the Modify pointer, which moves it to the next character in the table. At this time the "Move" subroutine is reentered (154). (This same process results in the fourth and fifth pressings of the switch also causing a blank to appear at the display associated with the switch.)

If the same switch is pressed a sixth time, the "Move" subroutine is reentered again and the character for a "queen" is output to the display RAM 44 at the address of the switch because the last step 162 in the program after the blank was output to the display RAM was to increment the Modify pointer. This process will continue if the same switch is repeatedly pressed, and all of the characters shown in FIG. 12 will be output to the RAM chip 44 and the display associated with the switch.

As can be seen, activation of two different switches will cause the character at the display associated with the first switch to be moved to the display associated with the second switch. But, sequential pressings of the same switch will cause all of the possible characters to be sequentially displayed at the display associated with the switch. The processes by which these operations are achieved are subroutines which operate from a primary routine which continually updates the entire playing surface.

In the embodiment described herein, a digital microprocessor and accompanying logic circuitry have been utilized to implement the principles of the present invention. However, it is to be understood that this invention can be implemented with other types of hardware. For example, other forms of digital logic ciruitry besides a monolithic microprocessor could easily be used to implement the logical processes described above. Also, it is possible for these logical processes to be implemented with non-digital hardware. For example, many of the early computers were implemented with relay logic. The differences between the relay logic used therein and the logic circuitry employed in today's computers primarily involve size and speed. Early forms of relay logic was capable of executing every type of logical decision executed by today's computers. Accordingly, it would be possible to implement the present invention with relay logic, and with other types of displays and switches than have been described herein.

Therefore, although in the foregoing description of the present invention, one embodiment of the invention has been disclosed, it is to be understood that other design variations are within the scope of the present invention as discussed above. Thus, by way of further example and not of limitation, varying types of logic circuitry could be utilized to implement the hardware described herein; the displays need not be implemented with segmental or liquid crystal type displays; the switches need not be designed such that the displays can be viewed through them; and; the rows and columns of displays could be updated in a different order; the logical sequence of operations may be performed in a different manner to achieve the same result. Also, the principles of the present invention would readily be applicable to the implementation of other games such as backgammon, "go", or Chinese checkers, for specific examples. Accordingly, the invention is not limited to the particular arrangement which has been illustrated and described in detail.

What is claimed is:

1. An electronic chessboard comprising:

means for generating electronic representations of all of the playing pieces used in the game of chess;

a plurality of display means, arranged to represent the playing surface of a chessboard, for continuously displaying said electronic representations of all of said playing pieces at each possible piece location on the playing surface;

means for causing said display means to display said electronic representations of said playing pieces in a position to begin a game of chess;

a plurality of switch means, each associated with one of said display means, for initiating transfer of said electronic representations of said playing pieces between said display means;

means for removing and storing said electronic representation present at a first of said display means upon said activation of said switch means associated with said first display means;

means for transferring, upon activation of a second switch means associated with a second of said display means, said stored representation to said second display means;

means for regenerating, at each of said display means, the electronic representation previously present at said display means when said switch means associated with said display means is activated more than once in succession;

means for cyclically generating said electronic representations of all of said playing pieces at any one of said display means when said switch means associated with said display means is activated more than twice in succession; and means for deactivating said display means and for storing the configuration of said playing surface when said chessboard is deactivated.

2. An electronic chessboard as defined in claim 1, wherein said means for removing and storing, said means for transferring, said means for regenerating, and said means for cyclically generating comprise logic circuitry means for generating and controlling movement of said electronic representation.

3. An electronic chessboard as defined in claim 2, wherein said logic circuitry means comprises:

a programmable digital microprocessor;

random access digital memory means, connected to said microprocessor and to said display means, for storing said electronic representation of said playing pieces at each of said display means;

read-only digital memory means, connected to said microprocessor, for permanently storing a program controlling the operation of said microprocessor;

means, connected between said switch means and said microprocessor, for interfacing said switch means to said microprocessor;

battery means, connected to all aforesaid means, for generating a supply voltage for all aforesaid means.

4. An electronic chessboard as defined in claim 1, wherein each of said display means comprises a seven-segment digital indicator circuit.

5. An electronic chessboard as defined in claim 1, wherein each of said display means comprises a liquid-crystal digital indicator circuit.

6. An electronic chessboard as defined in claim 1, wherein said switch means comprises a crossbar switching matrix.

7. An electronic chessboard as defined in claim 1, wherein said chessboard further comprises means for indicating whether any of said electronic representation of said playing pieces is being moved between any two of said display means.

8. A chessboard as defined in claim 7, wherein said means for indicating comprises a single light on one of said display units, connected to said means for moving, said light being activated when said switch means initiates said transfer of said electronic representations between said display means.

9. An electronic chessboard comprising:

a. means for generating electronic representations of all of the playing pieces used in the game of chess;

b. a plurality of display means, arranged to represent the playing surface of a chessboard, for displaying said electronic representations of all of said playing pieces at each possible piece location on the playing surface;

c. means for causing said display means to display said electronic representations of said playing pieces in a position to begin a game of chess;

d. crossbar switching matrix means, having a switch means associated with each of said display means, for initiating transfer of said electronic representations of said playing pieces between said display means;

e. means, connected to said switching means and to said display means, for moving said electronic representation of any one of said playing pieces between any two of said display means upon the activation of said switching means associated with said two display means;

f. said crossbar switching means comprising:

(1) a first substantially flat sheet of translucent plastic material disposed over said plurality of display means;

(2) a first plurality of pairs of connected electrical conductors attached to said first sheet, each of said pairs passing between two opposite sides of said chessboard and disposed along the peripheral limits of one of the columns of said display means formed by said arrangement of said display means;

(3) a second substantially flat sheet of translucent plastic material disposed above said first sheet, said second sheet including a pair of through holes above each of said conductors at the peripheral limits of each of said display means;

(4) a third sheet of translucent plastic material disposed above said second sheet;

(5) a second plurality of pairs of connected electrical conductors attached to the side of said third sheet closest to said second sheet and disposed perpendicular to said first plurality of conductors directly above said holes in said second sheet, whereby contact is made through said holes in said second sheet between one pair of said first plurality of conductors and one pair of said second pluralily of conductors by applying manual pressure to said third sheet;

(6) a fourth sheet of translucent material disposed above said third sheet, said fourth sheet being of a contrasting color relative to said sheets below said fourth sheet, thereby shielding said conductors from view;

(7) a fifth sheet of translucent material disposed above said fourth sheet, said fifth sheet being polarized;

(8) a sixth sheet of translucent material disposed above said fifth sheet, said sixth sheet being clear and causing, in conjunction with said fifth sheet, said switching matrix to have a mirrored appearance when viewed from above said chessboard; and (9) a seventh sheet of translucent plastic material disposed above said sixth sheet, said sheet having portions removed above alternate ones of said plurality of display means, thereby allowing said electronic representations displayed on said display means to be viewed from above said playing surface through said sheets and creating a checkerboard effect on said playing surface.

10. An electronic chessboard comprising:

a. means for generating electronic representations of all of the playing pieces used in the game of chess;

b. a plurality of display means, arranged to represent the playing surface of a chessboard, for displaying said electronic representations of all of said playing pieces at each possible piece location on the playing surface;

c. means for causing said display means to display said electronic representations of said playing pieces in a position to begin a game of chess;

d. switch means, each associated with one of said display means, for initiating transfer of said electronic representations of said playing pieces between said display means;

e. means, connected to said switch means and to said display means, for moving said electronic representation of any one of said playing pieces between any two of said display means upon the activation of said switch means associated with said two display means;

f. said switch means comprising:

(1) a substantially flat sheet of translucent plastic material disposed over said plurality of display means;

(2) a first plurality of pairs of connected electrical conductors attached to said first sheet, each of said pairs passing between two opposite sides of said chessboard ad disposed along the peripheral limits of one of the columns of said display means formed by said arrangement of said display means;

(3) a second substantially flat sheet of translucent plastic material disposed above said first sheet, said second sheet including a pair of through holes above each of said conductors at the peripheral limits of each of said display means;

(4) a third sheet of translucent plastic material disposed above said second sheet;

(5) a second plurality of pairs of connected electrical conductors attached to the side of said third sheet closest to said second sheet and disposed perpendicular to said first plurality of conductors directly above the holes in said second sheet, whereby contact is made through said holes in said second sheet between one pair of said first plurality of conductors and one pair of said second plurality of conductors by applying manual pressure to said third sheet;

(6) a fourth sheet of translucent material disposed above said third sheet, said fourth sheet being of a contrasting color relative to said sheets below said fourth sheet, thereby shielding said conductors from view;

(7) a fifth sheet of translucent material disposed above said fourth sheet, said fifth sheet being polarized;

(8) a sixth sheet of translucent material disposed above said fifth sheet, said sixth sheet being clear and causing, in conjunction with said fifth sheet, said switching matrix to have a mirrored appearance when viewed from above said chessboard; and (9) a seventh sheet of translucent plastic material disposed above said sixth sheet, said sheet having portions removed above alternate ones of said plurality of display means, thereby creating a checkerboard effect on said playing surface and allowing said electronic representations displayed on said display means to be viewed from above said playing surface through said sheets.

* * * * *